US010415926B2

(12) United States Patent
Schroeder

(10) Patent No.: US 10,415,926 B2
(45) Date of Patent: Sep. 17, 2019

(54) MULTICONFIGURATION FIREARM

(71) Applicant: Jeff Schroeder, Simi Valley, CA (US)

(72) Inventor: Jeff Schroeder, Simi Valley, CA (US)

( * ) Notice: Subject to any disclaimer, the term of this patent is extended or adjusted under 35 U.S.C. 154(b) by 79 days.

(21) Appl. No.: 15/897,450

(22) Filed: Feb. 15, 2018

(65) Prior Publication Data

US 2019/0249947 A1 Aug. 15, 2019

(51) Int. Cl.

| | |
|---|---|
| ***F41C 23/10*** | (2006.01) |
| ***F41C 7/00*** | (2006.01) |
| ***F41A 9/65*** | (2006.01) |
| ***F41A 3/66*** | (2006.01) |

(52) U.S. Cl.

CPC ..... *F41C 23/10* (2013.01); *F41A 3/66* (2013.01); *F41A 9/65* (2013.01); *F41C 7/00* (2013.01)

(58) Field of Classification Search

CPC .... F41C 23/10; F41C 7/00; F41A 3/66; F41A 9/65; F41A 3/58; F41A 9/61; F41A 9/64; F41A 17/36; F41A 17/38

USPC ..... 89/197

See application file for complete search history.

(56) References Cited

U.S. PATENT DOCUMENTS

| | | | | |
|---|---|---|---|---|
| 8,756,845 | B2 | 6/2014 | Harris | |
| 9,010,004 | B1 * | 4/2015 | Fu | F41A 17/38 42/49.01 |
| 9,182,186 | B1 * | 11/2015 | Prince | F41A 17/38 |
| 9,482,478 | B2 * | 11/2016 | Newman | F41A 17/38 |
| 9,599,429 | B1 * | 3/2017 | Davis | F41C 23/14 |
| 10,132,584 | B2 * | 11/2018 | Abbott | F41A 17/38 |
| 2013/0269232 | A1 * | 10/2013 | Harris | F41A 9/64 42/49.01 |
| 2013/0340312 | A1 * | 12/2013 | Fulton | F41C 23/14 42/73 |

OTHER PUBLICATIONS

NPL (https://www.calguns.net/calgunforum/showthread.php?t=1327436&page=2) Apr. 27, 2017.* youtube.com, Mar. 7, 2018, Internet printout: https://www.youtube.com/watch?v=fONOVYHzmKc.

youtube.com, Mar. 7, 2018, Internet printout: https://www.youtube.com/watch?v=d5Y7H5u6zNs.

facebook.com, Mar. 7, 2018, Internet printout: https://www.facebook.com/pg/OldcoastIndustries/photos/?ref=page_internal.

xtechtactical.com, Feb. 15, 2018, Internet printout: https://www.xtechtactical.com/product/atg-ar15-black/.

(Continued)

*Primary Examiner* — John Cooper

(74) *Attorney, Agent, or Firm* — Todd R. Miller

(57) ABSTRACT

A novel converter unit, system, and method of use with a firearm are disclosed. The converter unit may comprise a grip, pivot, and linkage. The grip is rotatably attached to the pivot, which in turn is attached to a receiver of a firearm. The linkage is in communication with the grip and a magazine release of the firearm such that rotation of the grip causes the linkage to slide toward or away from a muzzle of the firearm. The linkage and magazine release are preferably configured wherein the magazine release is not functional when the grip is angled away from the axis of the firearm. Conversely, when the axis of the grip is parallel to the axis of the firearm, the magazine release is functional.

13 Claims, 6 Drawing Sheets

(56) References Cited

OTHER PUBLICATIONS battlearmsdevelopmen.com, Feb. 15, 2018, Internet printout: http://www.battlearmsdevelopment.com/bad-atg-adjustable-tactical-grip-gry.
gunnewsdaily.com, Feb. 15, 2018, Internet printout: https://gunnewsdaily.com/featureless-ar-15-parts/.
resurgentarms.com, Feb. 15, 2018, Internet printout: https://resurgentarms.com/.

* cited by examiner

MULTICONFIGURATION FIREARM

BACKGROUND

The present disclosure relates generally to firearms and particularly to rifles that may be quickly and conveniently converted from one configuration comprising a fixed magazine and angled grip to an alternative configuration comprising a removable magazine and parallel grip.

SUMMARY

One exemplary embodiment of the disclosed subject matter is a converter unit comprising a grip, pivot, and linkage. The grip is rotatably attached to the pivot, which in turn is attached to a receiver of a firearm. The linkage is in communication with the grip and a magazine release such that rotation of the grip causes the linkage to slide toward or away from a muzzle of the firearm. The linkage and magazine release are preferably configured wherein the magazine release is not functional when the grip is angled away from the axis of the firearm. Conversely, when the axis of the grip is parallel to the axis of the firearm, the magazine release is functional.

Yet another exemplary embodiment is a device for converting a firearm between a fixed magazine, angled grip configuration to a removable magazine, parallel grip configuration, the device comprising a grip having an axis, wherein the grip is rotatably disposed about a receiver of a firearm having an axis, and a linkage in communication with the grip and a magazine release of the firearm. The linkage is configured to stop the magazine release from being depressed when the grip is angled away from the axis of the firearm. The linkage is also configured to permit the magazine release to be pressed when the axis of the grip is parallel to the axis of the firearm. The linkage may include a linkage channel configured to receive a pin extending from the grip. The linkage may also include a linkage receiver configured to receive a magazine release slot cut into the magazine release. The device may further comprise a pivot having a pin extending therefrom, wherein the grip includes a hole for receiving the pin of the pivot for rotatably connecting the grip to the pivot. The pivot may be mounted to the receiver via a screw or the like. The device may also include a bracket having a channel, wherein the bracket is mounted to the receiver, and wherein the channel is configured to slideably receive the linkage.

Another exemplary embodiment of the disclosed subject matter is a convertible firearm system comprising a rifle having a first end and an opposing second end, wherein the rifle has an axis, wherein a butt is at the first end of the rifle, wherein a muzzle is at the second end of the rifle, wherein a receiver is disposed between the butt and the muzzle, and wherein the receiver has a magazine release. The system may also include a converter unit comprising a pivot mounted to the receiver, a grip rotatably mounted to the pivot, and a linkage in communication with the grip and the magazine release wherein rotation of the grip causes the linkage to slide toward or away from the muzzle to permit or preclude the magazine release from being functional.

A further example of the disclosed subject matter is a method of converting a firearm between a fixed magazine, angled grip configuration to a removable magazine, parallel grip configuration. The method preferably comprises rotatably mounting a grip to a receiver of a firearm, and connecting a linkage mechanism between the grip and a magazine release of the firearm. Rotating the grip at an angle to the firearm causes the linkage to preclude the magazine release from being pressed. In contrast, rotating the axis of the grip to be parallel to the axis of the firearm moves the linkage to permit the magazine release to be pressed.

BRIEF DESCRIPTION OF THE DRAWINGS

Some non-limiting exemplary embodiments of the disclosed subject matter are illustrated in the following drawings. Identical or duplicate or equivalent or similar structures, elements, or parts that appear in one or more drawings are generally labeled with the same reference numeral, optionally with an additional letter or letters to distinguish between similar objects or variants of objects, and may not be repeatedly labeled and/or described. Dimensions of components and features shown in the figures are chosen for convenience or clarity of presentation. For convenience or clarity, some elements or structures are not shown or shown only partially and/or with different perspective or from different point of views.

DETAILED DESCRIPTION

One popular type of firearm is a modern rifle having a fixed magazine and an angled grip. Another type has a removable magazine and a parallel grip. Conversion of a rifle from one of these types to the other is possible and often desirable to use the rifle for different purposes, or merely in accordance with user preference. However, conversion is a difficult, time consuming process involving disassembly and gunsmithing.

Accordingly, a firearm that permits efficient and rapid conversion from a fixed magazine, angled grip configuration to a removable magazine, parallel grip configuration is desired.

A general non-limiting overview of practicing the present disclosure is presented below. The overview outlines exemplary practice of embodiments of the present disclosure, providing a constructive basis for variant and/or alternative and/or divergent embodiments, some of which are subsequently described.

Figure 1:
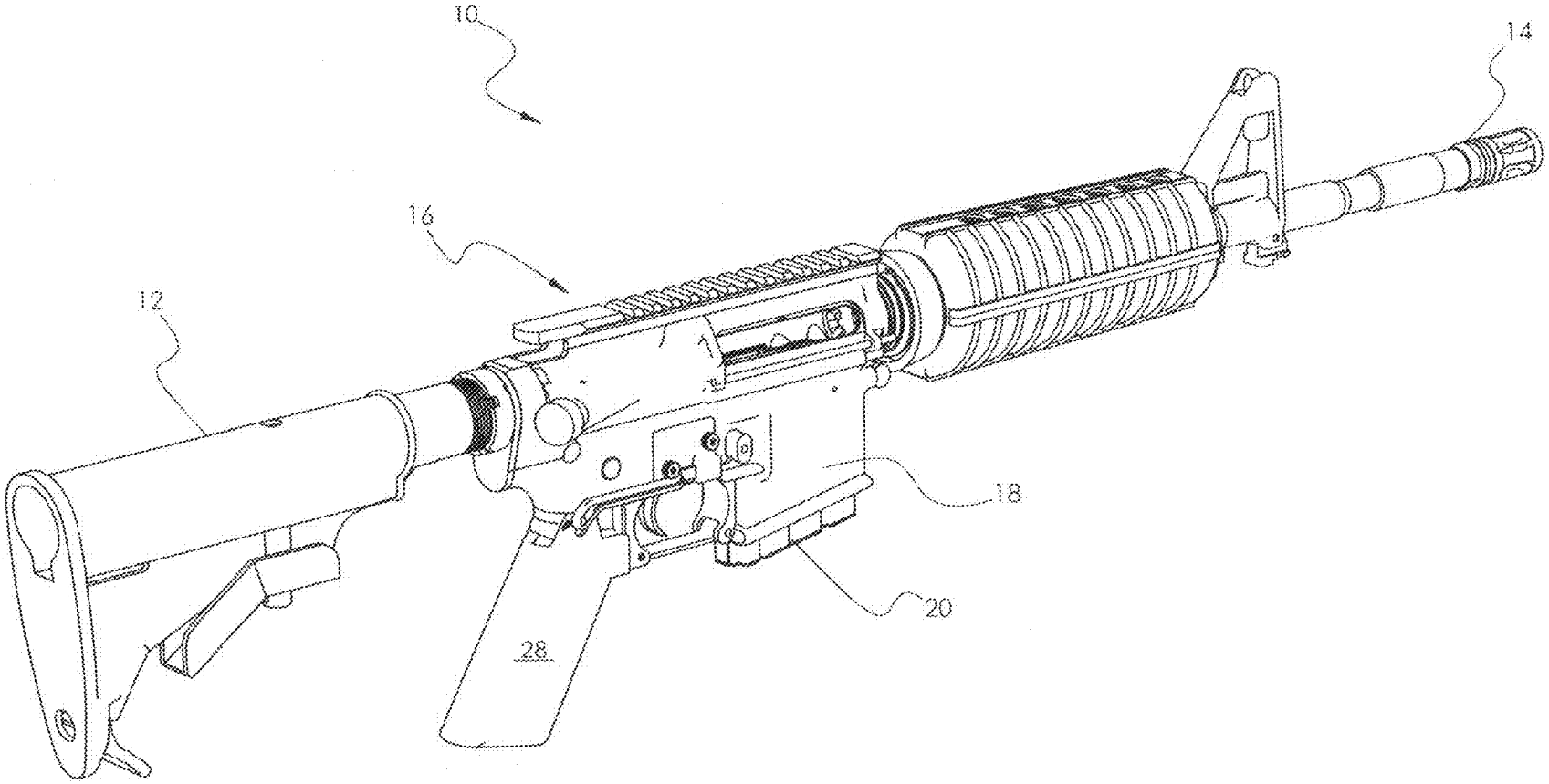
FIG. 1 is a perspective view of an embodiment of the mulitconfiguration firearm disclosed herein.

FIG. 1 illustrates a firearm 10 having a butt 12 at one end and a muzzle 14 at an opposing end. Proximate the middle of the two ends lays a receiver 16 having a magazine well 18 and a magazine release 22. The magazine well 18 is configured to receive a magazine 20 that may store ammunition. A grip 28 extends from the receiver 16 for holding the firearm 10 when in operation.

FIGS. 1-4 illustrate the firearm 10 in a fixed magazine, angled grip configuration. As shown, the magazine 20 is not detachable when the grip 28 is at an angle to the receiver 16. The term "angle" is best understood with reference to FIG.

4. There, grip 28 may be seen as having an axis 30 and firearm 10 may be seen as having an axis 26. There is an angle therebetween such that the grip 28 extends from the receiver 16 at fixed angle 60, which is greater than 0° and preferably less than 90°.

Figure 5:
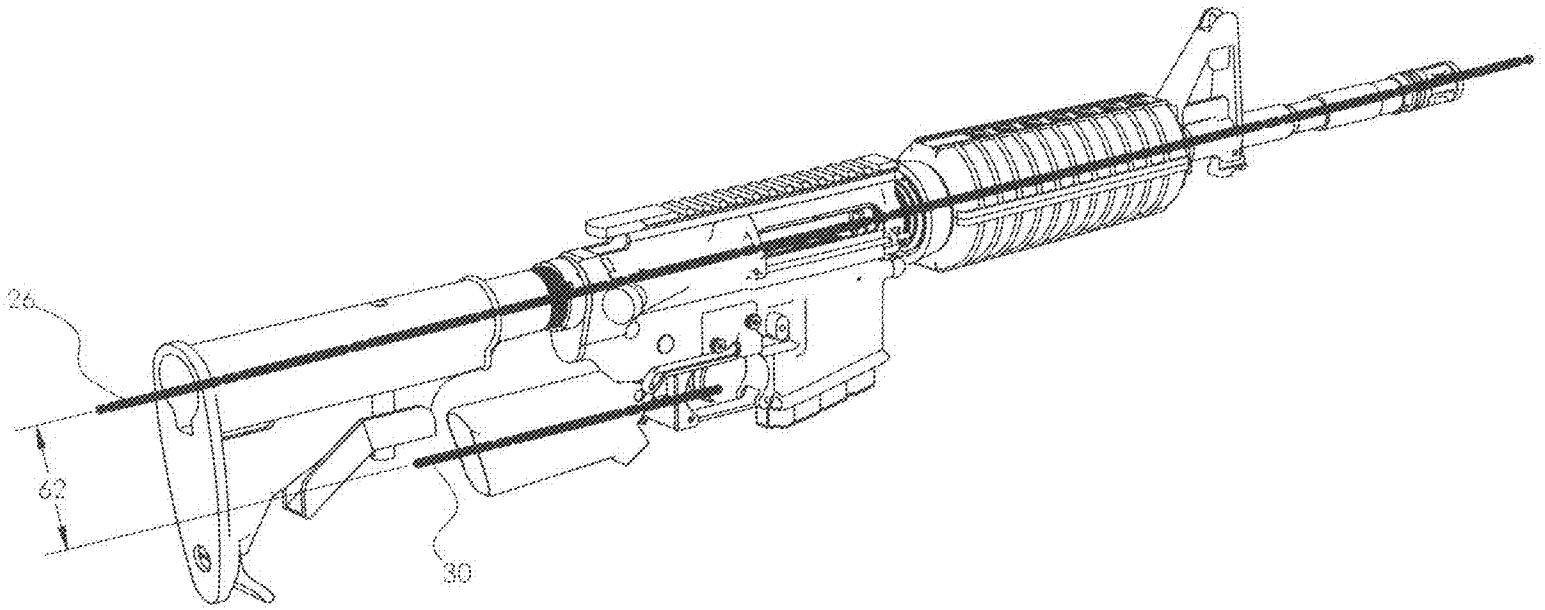
FIG. 5 is a perspective view of the mulitconfiguration firearm of FIG. 1 illustrating a rifle axis, grip axis, and removable angle therebetween wherein the magazine is removable.
Figure 6:
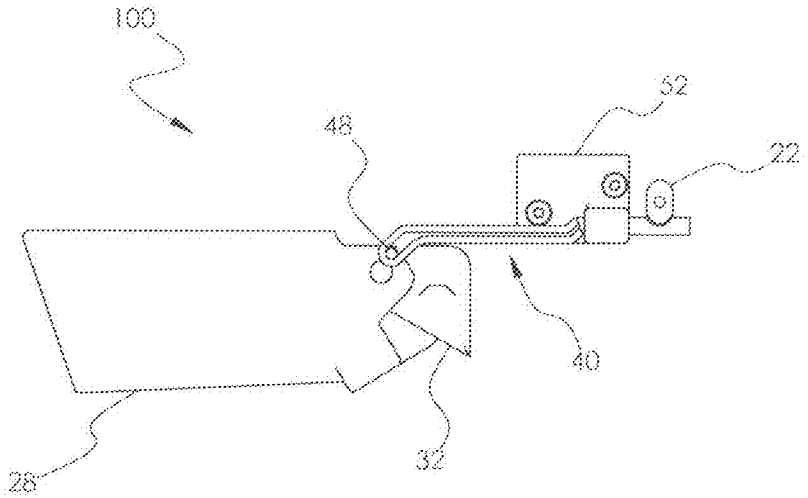
FIG. 6 is a side view of details of the conversion unit seen in FIG. 5.

FIGS. 5-6 illustrate the firearm 10 in a removable magazine, parallel grip configuration. Stated differently, the magazine 20 is detachable when the grip 28 has its axis 30 parallel to the axis 26 of the firearm 10. This concept is best seen in FIG. 5 wherein the grip 28 extends from the receiver 16 at removable angle 62, which is 0°.

The firearm 10 may be quickly and conveniently converted from the fixed magazine, angled grip configuration (as seen in FIGS. 1-4) to the removable magazine, parallel grip configuration (as seen in FIGS. 5-6) by way of a converter unit 100. The converter unit 100 permits the grip 28 to be rotated about a pivot point, which in turn permits the magazine release 22 to be engageable, as disclosed below.

Figure 2:
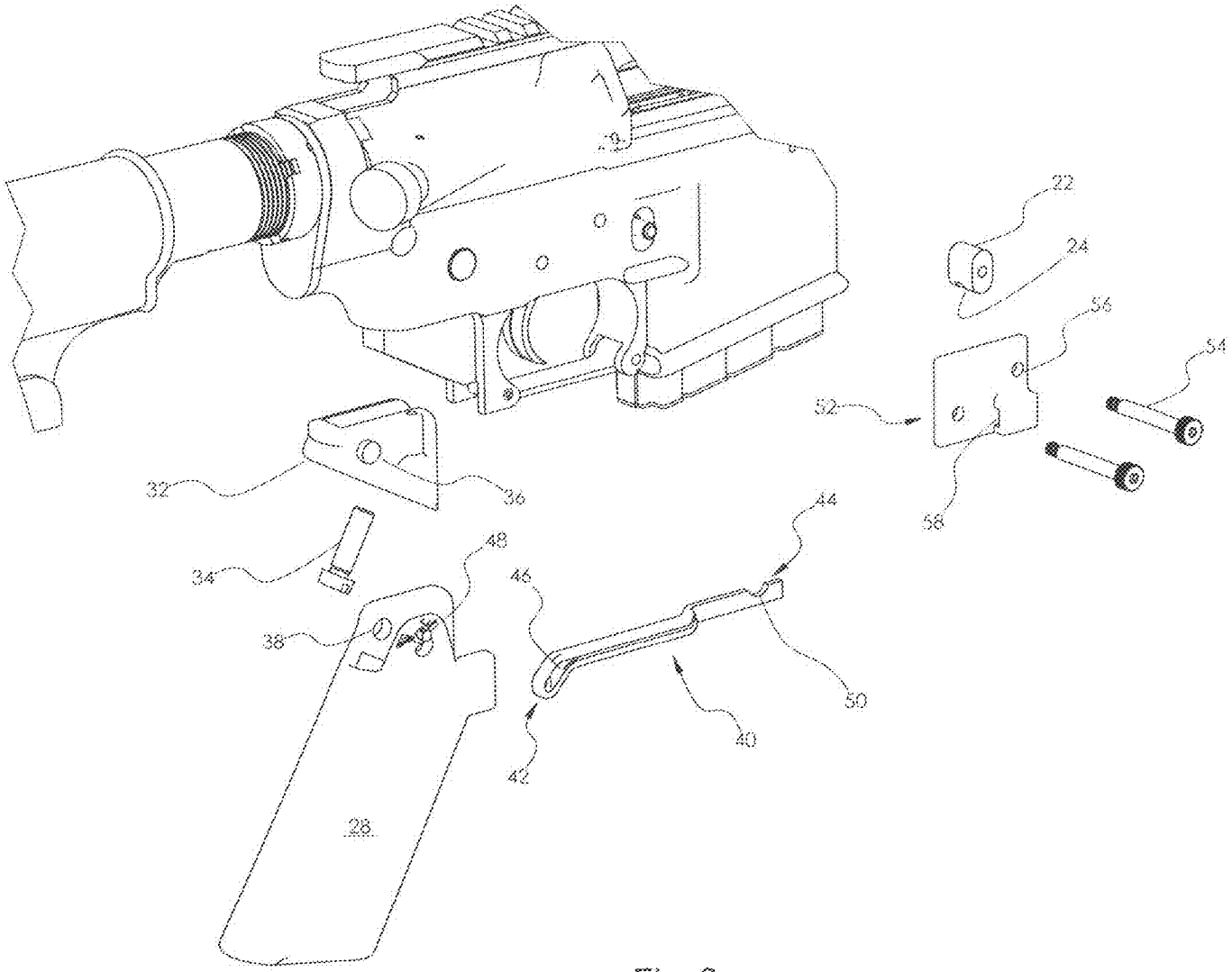
FIG. 2 is a fragmentary perspective, exploded view of details of the conversion unit seen in FIG. 1.

Referring in detail to FIG. 2, the converter unit 100 may comprise grip 28, pivot 32, and linkage 40. Grip 28 is rotatably attached to pivot 32 via rotating boss 36 or pin, hinge, or the like that is received in hole 38 of the grip 28. The pivot 32 may be attached to the receiver 16 by screw 34 or similar method such as via a pin, friction fit, weld, or the like.

The linkage 40 is in communication with grip 28 and magazine release 22. In particular, the rear end 42 of linkage 40 has a linkage channel 46 configured to receive pin 48 (or screw, boss, gear, tab, or the like) disposed at the top of grip 28. The opposing front end 44 of linkage 40 has a linkage receiver 50 configured to receive magazine release 22 and particularly release slot 24 cut therein or like arrangement. The body of linkage 40 may be bent so the rear end 42 abuts the top of grip 28 and the front end 44 abuts the receiver 16 and lines up with the release slot 24 of the magazine release 22. The linkage 40 is preferably held in place against the receiver 16 by bracket 52 having a channel 58 that receives linkage 40. In the alternative, the channel 58 or the like may be cut within the receiver 16 itself. The bracket 52 may be mounted to the receiver 16 via one or more holes 56 in the bracket 52 and mounting means, such as screws 54, or the like. The linkage 40 is slideably disposed to move toward or away from the muzzle 14 of the firearm 10 depending on the angle of the grip 28 to the firearm 10.

Figure 3:
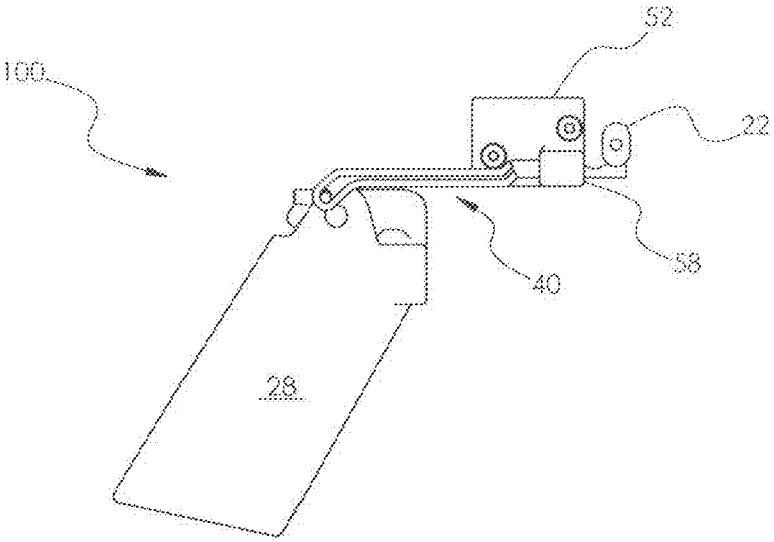
FIG. 3 is a side view of details of the conversion unit seen in FIG. 2.
Figure 4:
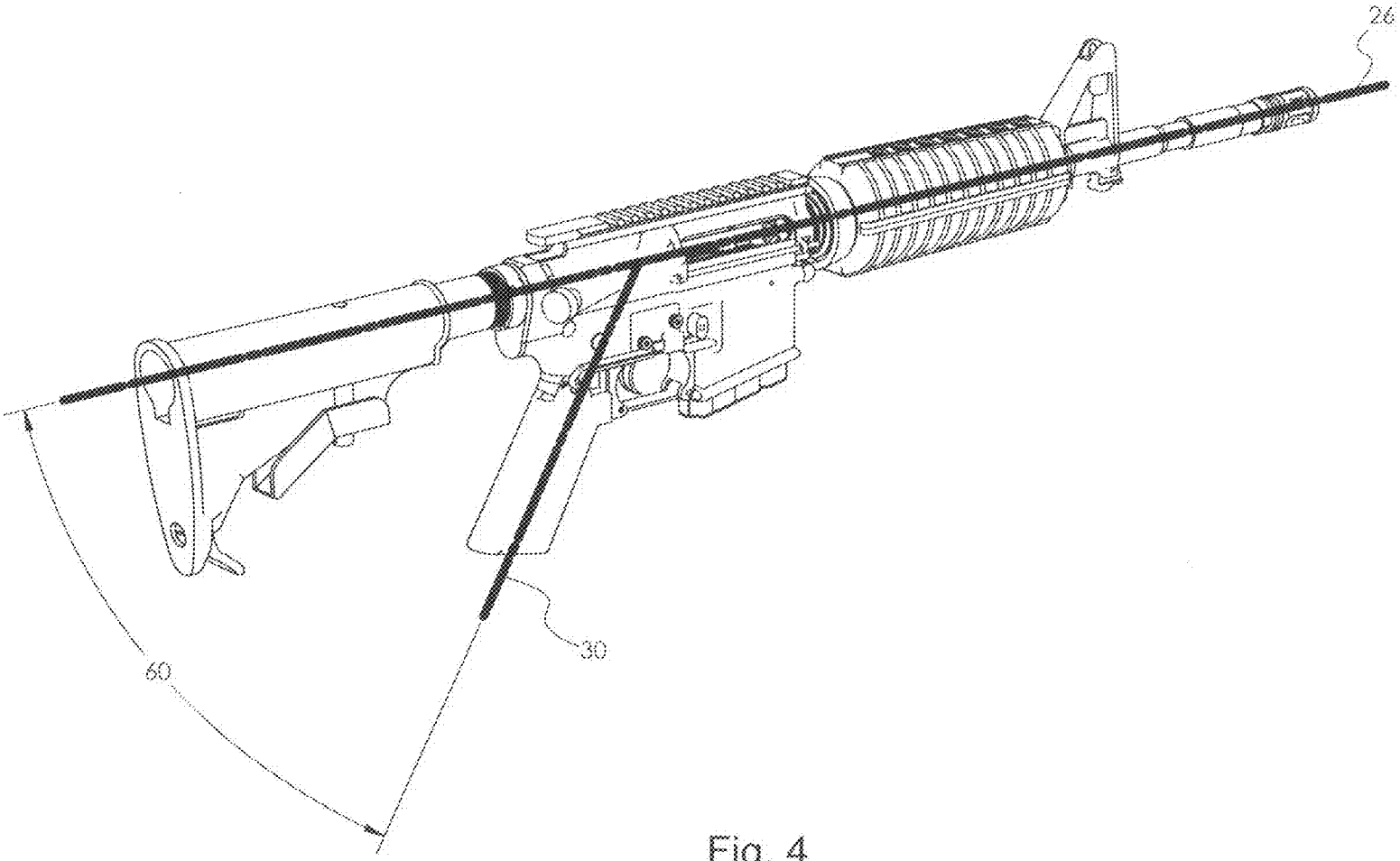
FIG. 4 is a perspective view of the mulitconfiguration firearm of FIG. 1 illustrating a rifle axis, grip axis, and fixed angle therebetween wherein the magazine is fixed.

For example, as seen best in FIG. 3, grip 28 is at an angle greater than 0° and less than 90° to the axis 26 of firearm 10. In this configuration, the linkage 40 has been moved away the muzzle 14 wherein the rear end 44 of the linkage 40 is seated against the interior of magazine release slot 24 to preclude the magazine release 22 from being engaged by the user. In other words, the magazine 20 is in a fixed configuration due to the angled grip.

In yet another example, as seen best in FIG. 6, grip 28 is at an angle that is 0° to the axis 26 of firearm 10, i.e., the axis 30 of grip 28 is parallel to the axis 26 of firearm 10. In this configuration, the linkage 40 has been moved toward the muzzle 14 wherein the linkage receiver 50 is seated in magazine release slot 24 to permit the magazine release 22 to be engaged by the user. Thus, the magazine 20 is in a removable configuration due to the lack of an angled grip and/or parallel relationship of the grip 28 to the firearm 10.

It should now be readily apparent that the converter unit 100 disclosed herein permits efficient and rapid conversion from a fixed magazine, angled grip configuration to a removable magazine, parallel grip configuration. Moreover, such multiconfiguration need not be obtained only via the sale of the original firearm 10. The novel converter unit 100 may also be sold as a retrofit kit to allow a user to obtain such multifunctionality with a firearm that had only one configuration previously possible.

While certain embodiments have been described, the embodiments have been presented by way of example only and are not intended to limit the scope of the inventions. Indeed, the novel converter unit described herein may be embodied in a variety of other forms. Furthermore, various omissions, substitutions, and changes in the form of the disclosed elements may be made without departing from the spirit of the inventions. The accompanying claims and their equivalents are intended to cover such forms or modifications as would fall within the scope and spirit of the inventions.

The invention claimed is:

1. A device for converting a firearm between a fixed magazine, angled grip configuration to a removable magazine, parallel grip configuration, the device comprising:

a grip having an axis, wherein the grip is rotatably disposed about a receiver of a firearm having an axis; and a linkage in communication with the grip and a magazine release of the firearm, wherein the linkage includes a linkage channel configured to receive a pin extending from the grip, wherein the linkage is configured to stop the magazine release from being depressed when the grip is angled away from the axis of the firearm, and wherein the linkage is configured to permit the magazine release to be pressed when the axis of the grip is parallel to the axis of the firearm.

2. The device of claim 1, wherein the linkage includes a linkage receiver configured to receive a magazine release slot cut into the magazine release.

3. The device of claim 1, further comprising a pivot having a pin extending therefrom, and wherein the grip includes a hole for receiving the pin of the pivot for rotatably connecting the grip to the pivot.

4. The device of claim 3, wherein the pivot is mounted to the receiver via a screw.

5. The device of claim 1, further comprising a bracket having a channel, wherein the bracket is mounted to the receiver, and wherein the channel is configured to slideably receive the linkage.

6. A convertible firearm system comprising:

a rifle having a first end and an opposing second end, wherein the rifle has an axis, wherein a butt is at the first end of the rifle, wherein a muzzle is at the second end of the rifle, wherein a receiver is disposed between the butt and the muzzle, and wherein the receiver has a magazine release having a magazine release slot; and a converter unit comprising:

a pivot mounted to the receiver;

a grip rotatably mounted to the pivot; and a linkage in communication with the grip and the magazine release wherein rotation of the grip causes the linkage to slide toward or away from the muzzle to permit or preclude the magazine release from being functional, and wherein the linkage includes a linkage receiver configured to receive the magazine release slot.

7. The system of claim 6, wherein the linkage includes a linkage channel configured to receive a pin extending from the grip.

8. The system of claim 6, wherein the pivot is mounted to the receiver via a screw.

9. The system of claim 6, further comprising a bracket having a channel, wherein the bracket is mounted to the receiver, and wherein the channel is configured to slideably receive the linkage.

10. A method of converting a firearm between a fixed magazine, angled grip configuration to a removable magazine, parallel grip configuration, the method comprising:

rotatably mounting a grip to a receiver of a firearm; and connecting a linkage mechanism between the grip and a magazine release of the firearm, wherein rotating the grip at an angle to the firearm causes the linkage to preclude the magazine release from being pressed, wherein the firearm has an axis, wherein the grip has an axis, and wherein rotating the axis of the grip to be parallel to the axis of the firearm moves the linkage to permit the magazine release to be pressed, wherein the linkage includes a linkage channel configured to receive a pin extending from the grip.

11. The method of claim 10, wherein the linkage includes a linkage receiver configured to receive a magazine release slot cut into the magazine release.

12. The method of claim 10, further comprising a pivot having a pin extending therefrom, and wherein the grip includes a hole for receiving the pin of the pivot for rotatably mounting the grip to the pivot.

13. The method of claim 10, further comprising a bracket having a channel, wherein the bracket is mounted to the receiver, and wherein the channel is configured to slideably receive the linkage.

* * * * *